US006579135B2

(12) United States Patent
Nemoto et al.

(10) Patent No.: US 6,579,135 B2
(45) Date of Patent: Jun. 17, 2003

(54) OUTBOARD ENGINE

(75) Inventors: Hideki Nemoto, Wako (JP); Shoichi Rinzaki, Wako (JP); Masayuki Ohsumi, Wako (JP)

(73) Assignee: Honda Giken Kogyo Kabushiki Kaisha (JP)

( * ) Notice: Subject to any disclaimer, the term of this patent is extended or adjusted under 35 U.S.C. 154(b) by 0 days.

(21) Appl. No.: 10/068,448

(22) Filed: Feb. 6, 2002

(65) Prior Publication Data

US 2002/0111084 A1 Aug. 15, 2002

(30) Foreign Application Priority Data

Feb. 13, 2001 (JP) ..... 2001-035209

(51) Int. Cl.[7] ..... B63H 20/32
(52) U.S. Cl. ..... 440/76; 440/77
(58) Field of Search ..... 440/77, 76, 78, 440/49

(56) References Cited

U.S. PATENT DOCUMENTS

| | | | | | |
|---|---|---|---|---|---|
| 5,018,995 | A | * | 5/1991 | Sumigawa | 440/63 |
| 5,938,491 | A | * | 8/1999 | Kawai et al. | 440/77 |
| 6,024,616 | A | * | 2/2000 | Takayanagi | 440/77 |
| 6,149,477 | A | * | 11/2000 | Toyama | 440/88 |

FOREIGN PATENT DOCUMENTS

| | | |
|---|---|---|
| JP | 57027199 | 2/1982 |
| JP | 58158000 | 10/1984 |

* cited by examiner

*Primary Examiner*—Stephen Avila
(74) *Attorney, Agent, or Firm*—Adams & Wilks

(57) ABSTRACT

An outboard engine with a grip recess formed on a part of an engine cover surface. The grip recess can be used as a handle by inserting an operator's hand thereinto. The outboard engine may be lifted up by using the grip recess as a handle during a tilt-up operation. This allows the outboard engine to be rotated upwardly easily about a tilt axis.

18 Claims, 7 Drawing Sheets

41
43
46
43d
40
42
40c
48
45
46
40d
40a
48
48
50c
50
2
51
55
57
52
56
53
52a
50b
55
52
53
50a
58
53
51a
15c
15a'
15d
60
60
15a
15b
15c
60
15

OUTBOARD ENGINE

FIELD OF THE INVENTION

The present invention relates to an outboard engine which allows an easy tilt-up operation relative to a boat.

BACKGROUND OF THE INVENTION

An outboard engine is attached to a stern of a boat through a stern bracket, so that the outboard engine may be steered and moved up and down (tilt-up operation).

Tilt-up operation is performed by vertically pivoting or rotating the outboard engine, attached to a stern, about a tilt axis, when, for example, the boat moves through shallow water or needs to avoid driftwood. A conventional outboard engine structure is known from, for example, Japanese Patent Laid-Open Publication No. SHO-57-27199 and SHO-59-15800 for allowing a tilt-up operation.

The outboard engine in Japanese Patent Laid-Open Publication No. SHO-57-27199 includes a lever for performing the tilt-up operation. Because the structure of the outboard engine is such that the lever comprises a separate unit that juts upward from a top surface of a cover of the outboard engine, the aesthetics of the outboard engine are compromised. Additional components lead to increased costs.

The outboard engine in Japanese Patent Laid-Open Publication No. 59-15800 has a recess in the rear portion of an upper engine cover, and the opening of this indentation faces toward the back of the outboard engine and serves as a handle for tilt-up operation. This structure makes the tilt-up operation difficult, when the outboard engine is large, because the distance between the steer of the boat (front portion of the outboard engine) and the lever is too long.

SUMMARY OF THE INVENTION

It is therefore an objective of the present invention to provide an outboard engine that facilitates easy tilt-up operation while avoiding unnecessary cost increases.

According to an aspect of the present invention, there is provided an outboard engine comprising: an engine; an engine cover for covering the engine and its peripheral equipment; an under cover mounted to the bottom of the engine cover; an extension case mounted to the bottom of the under cover; a gear case having a screw and placed in the lower part of the extension case; and a recess formed on a part of the top surface of the engine cover to provide a grip for holding the top portion of the engine cover by hand.

In the outboard engine thus arranged, it is possible to perform the tilt-up operation by inserting fingers into the grip recess to get a hold on the outboard engine and lift the outboard engine, which includes the engine cover, about a tilt axis. When the outboard engine is large, both hands may be inserted into the grip recess for performing the tilt-up operation.

The grip recess is placed in the rear part of the top of the engine cover, thereby allowing easy rotation of the outboard engine with a tilt operation.

The engine cover comprises an engine cover body and a separate top cover, which is coupled onto the top of the engine cover body to form a single unit. The grip recess is formed on the top cover. When the outboard engine is large, the grip recess can be formed more easily, the engine cover with the grip recess can be manufactured more easily, and the entire structure may be simplified, when the top cover comprises a separate unit from the engine cover, the grip recess is formed on the top cover, and the top cover is coupled to the engine cover.

The grip recess comprises an opening formed on the top cover, a curved guide surface on the lower part of the opening, and rounded ends at both ends of the opening to ensure easy and sure insertion of a hand into the grip recess. The curved guide surface facilitates smooth hand insertion. The rounded ends enhance the strength of the grip recess.

BRIEF DESCRIPTION OF THE DRAWINGS

A preferred embodiment of the present invention will be described in detail herein below, by way of example only, with the reference to the accompanying drawings, in which.

DETAILED DESCRIPTION OF THE PREFERRED EMBODIMENT

Figure 1:
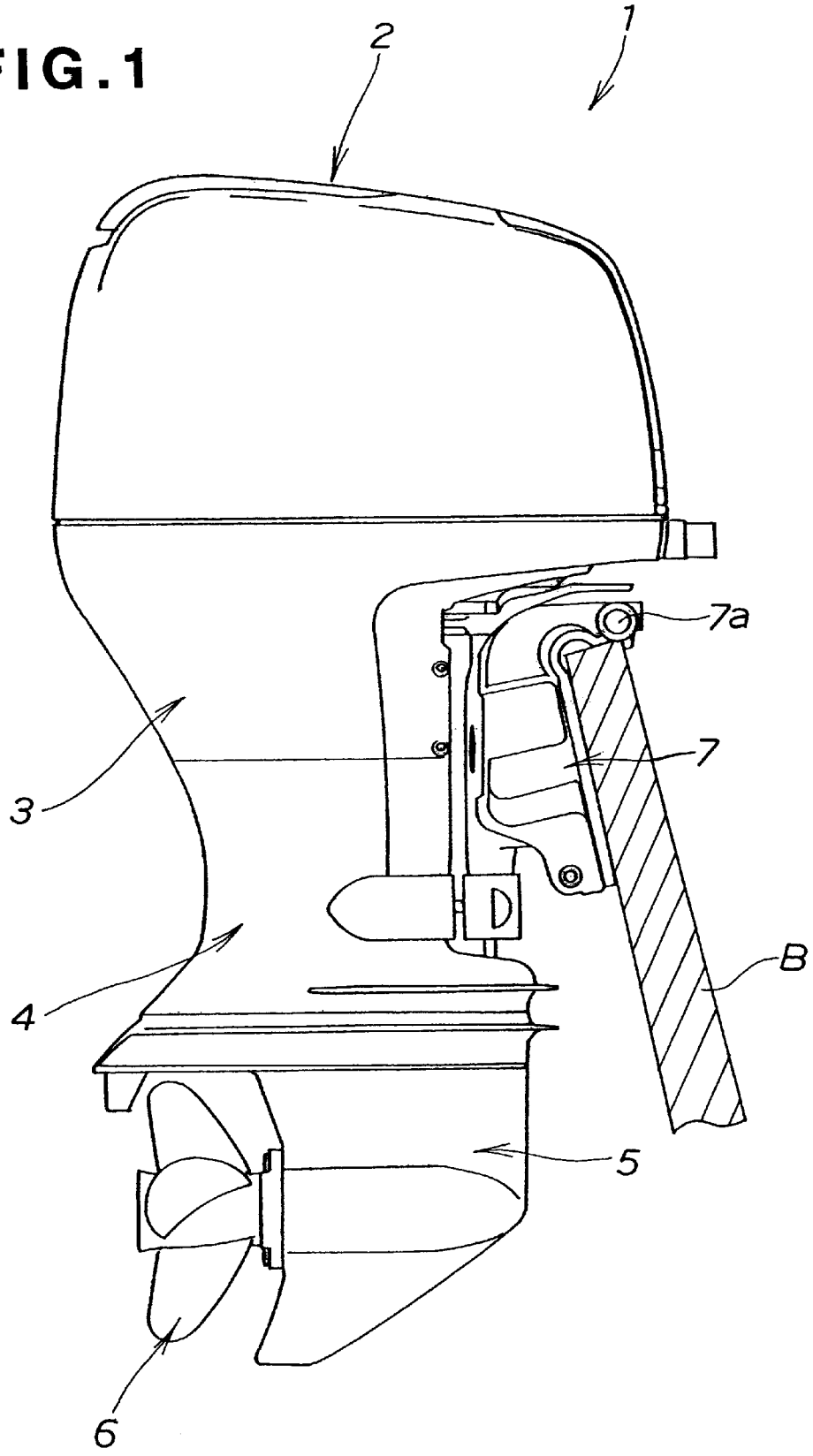
FIG. 1 is a side view illustrating an outboard engine, as attached to the steer of a boat, embodying the present invention.

Referring to FIG. 1, the outboard engine 1 comprises a housing formed of a top engine cover 2, an under cover 3 placed in the lower part of the engine cover, an extension case 4 extending from the lower part of the under cover 3, and a gear case 5 placed in the lower part of the extension case 4. One or more screws or propellers 6 are placed in the back part of the gear case 5. This outboard engine unit 1 is attached to the boat through a stern bracket 7 attached to a steer B. The outboard engine 1 moves up and down pivotably about a tilt axis 7*a*.

Figure 2:
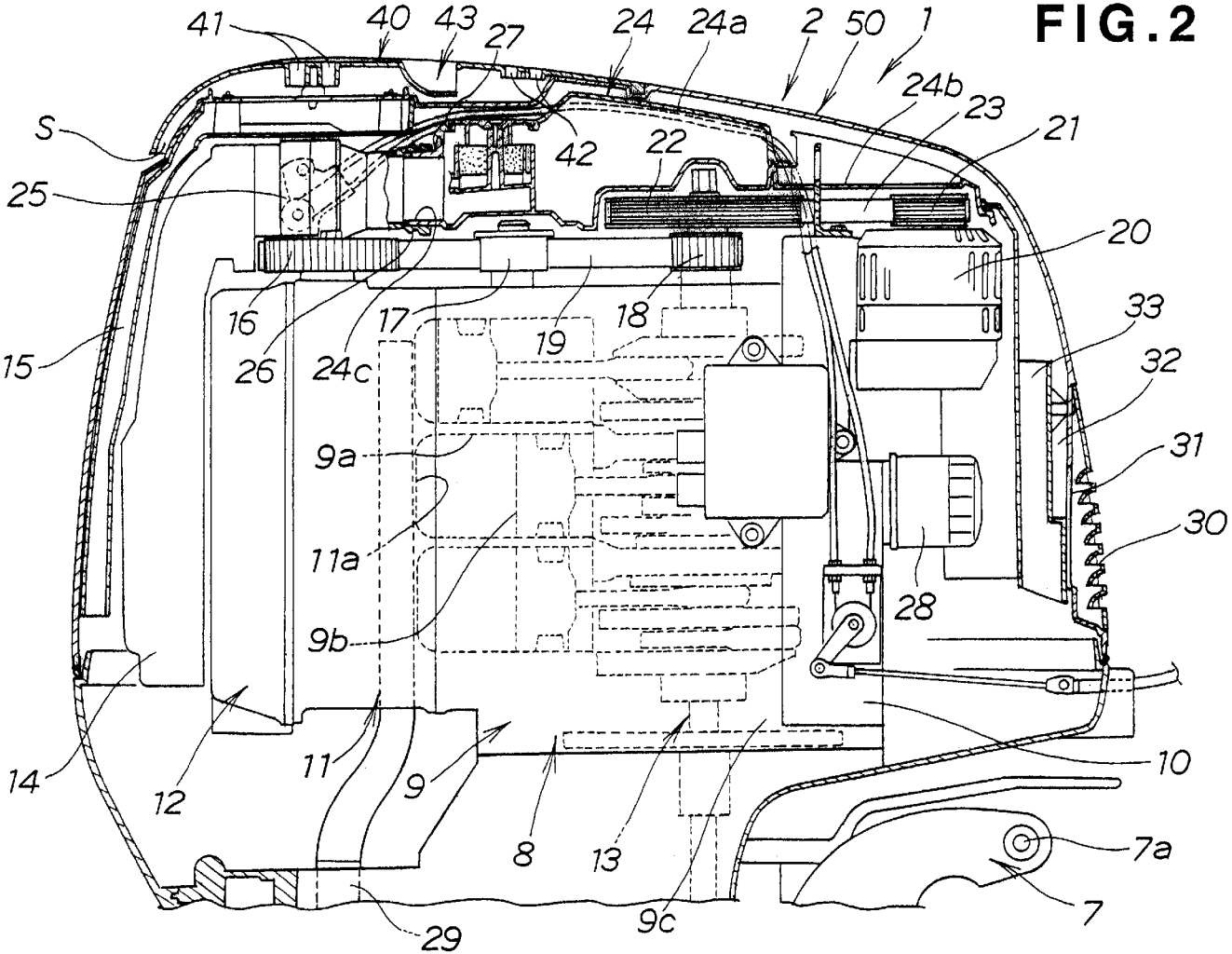
FIG. 2 is an enlarged cross sectional view illustrating the cross section of the top part of the outboard engine in FIG. 1.

Referring to FIG. 2, the outboard engine 1 includes an engine 8. The engine 8 includes a cylinder block 9, a crank case 10 placed in the front part of a skirt 9*c* of the cylinder block 9, a cylinder head 11 placed in the rear part of the cylinder block 9, and a cylinder head cover 12 placed in the rear part of the cylinder head 11. The engine 8 comprises a vertical engine whose crankshaft 13 is disposed vertically. The cylinder block 9 includes a plurality of horizontal cylinders 9*a* (in the illustrated example, three cylinders) horizontally laid in parallel relation to each other. Each cylinder 9*a* has a piston 9*b* in it. Each piston 9*b* is linked to a crankshaft 13 through a connecting rod. Cylinder head 11 has a plurality of combustion chambers 11*a* corresponding to the cylinders 9*a*. The engine 8 in this particular example embodiment is a V-shaped 6-cylinder engine.

In the rear part of the cylinder head 11 is an intake manifold 14 that extends in the up and down directions. An air intake guide 15 is placed at the rear part of the intake manifold 14.

Camshaft pulley 16 is placed in the upper part of the cylinder head 11. Guide pulley 17 is placed in the upper part of the rear of the cylinder block 9. A first driver pulley 18, driven by the crankshaft 13, is placed in the upper part of the skirt 9*c*. Timing belt 19 links a camshaft pulley 16 and the first driver pulley 18. A camshaft, not shown in this FIG., is driven with the rotation of the crankshaft 13 and through the first driver pulley 18, timing belt 19, and camshaft pulley 16.

Generator (ACG) 20 is attached to the upper front surface of the crank case 10, which comprises the front part of the engine. Driven pulley 21 for driving the generator is placed on the top surface of the generator 20. Second driver pulley 22 is placed on the top part of the crankshaft 13. The second driver pulley 22 and the driven pulley 21 are linked by a driver belt 23. Generator 20 is driven by the rotation of crankshaft 7 through the second driver pulley 22, driver belt 23, and driven pulley 21.

A box-shaped intake muffler 24 is placed above the belt pulley structure, which is placed above the engine 8, in the middle to rear part of the belt pulley structure. Box-shaped front half 24*a* of the intake muffler 24 is placed on the top part of the aforementioned second driver pulley 22. A front half 24*b* of the intake muffler 24 is shaped like a shelf and is located on the top part of the driven pulley 21 of the generator 20. The front portion 24*b*, in the shape of a shelf, is formed as a separate unit from the box part and joined to the box part.

The intake muffler 24 includes an intake connector duct 24*c* in the rear. The intake connector duct 24*c* is linked to grommet 26 in the upstream portion of the intake path of a throttle valve 25 placed in the upper rear part of engine 8.

In the Figure, reference numeral 27 designates a control cable for controlling the throttle valve. The control cable 27 extends along one side of the top surface of the intake muffler 24 toward the front, goes down from the front portion 24*b* and through the crankcase 10 and extends to the front of the outboard engine 1. Reference numeral 28 denotes an oil filter, and reference numeral 29 designates an exhaust pipe.

Engine cover 2 covers the engine 8 and some peripheral equipment. Engine cover 2 includes a plurality of slits 30 for intake which are formed in the front and lower part of the engine cover 2. Intake through the slit 30 passes through an intake opening 31 and passes through cooling paths 32 and 33 to cool the generator 20. The cooling paths 32 and 33 comprise a moisture separator.

Top cover 40 is placed in the upper rear part of engine cover 2. Grip recess 43 is formed toward the front part of the top cover 40, as shown in detail in FIGS. 3 and 4.

Figure 3:
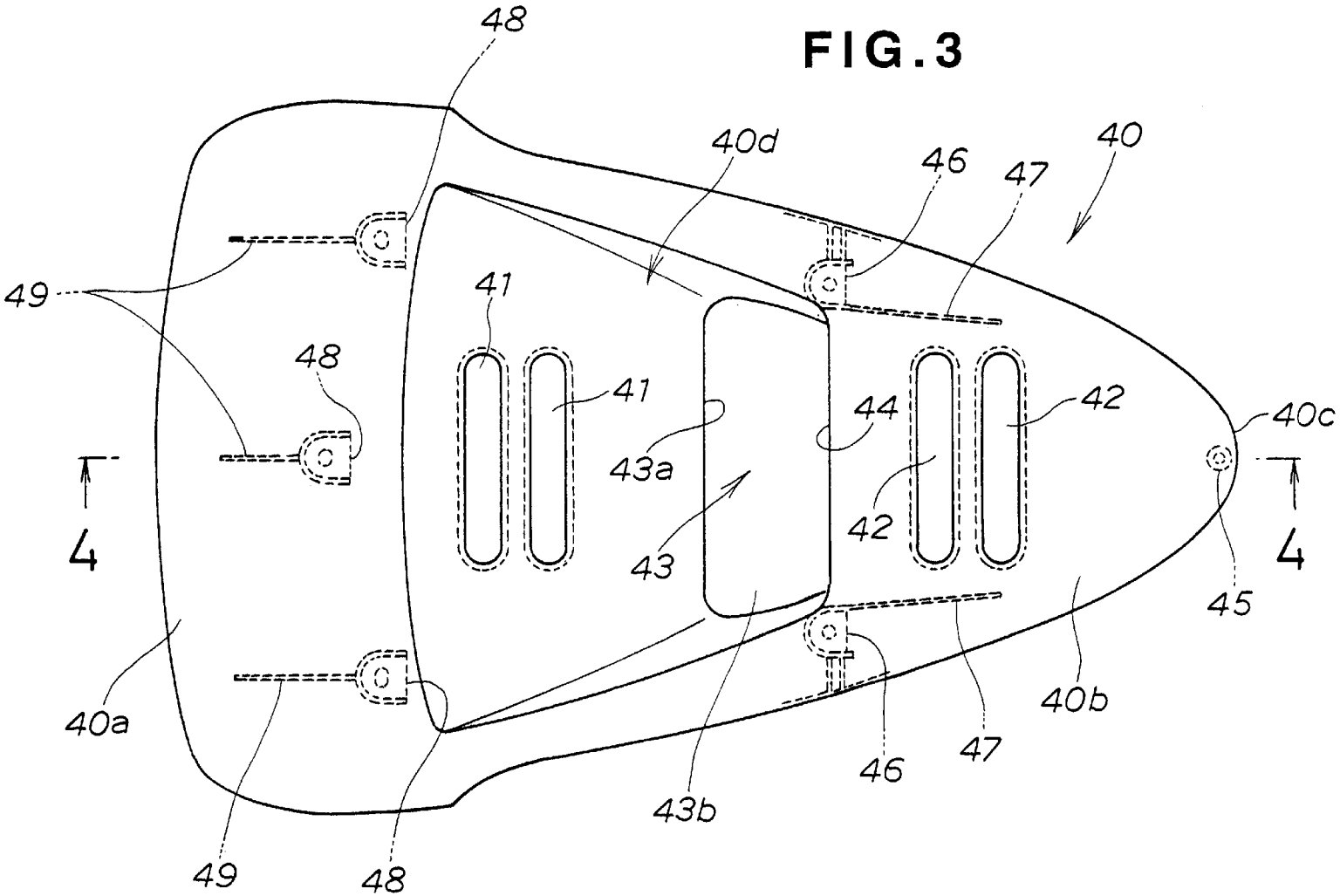
FIG. 3 is a top plan view of the top cover with the grip recess shown in FIG. 2.
Figure 4:
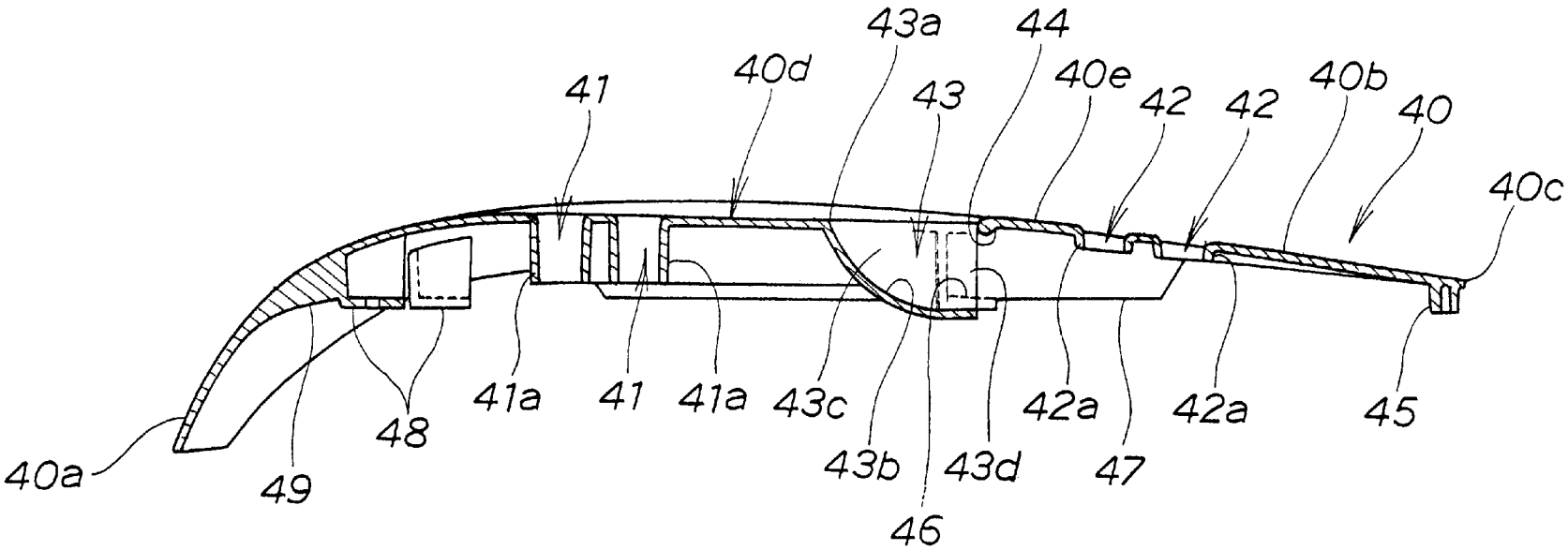
FIG. 4 is a cross-sectional view taken along line 4—4 in FIG. 3.

When viewed from the top, the top cover 40 forms a long plate that extends from front to back in FIGS. 3 and 4. A rear part 40*a* of the top cover 40 is wide in the right-left directions, while a front part 40*b* of the top cover 40 is narrow, and a front edge part 40*c* of the top cover 40 is cylindrically shaped.

Top cover 40 includes a shallow recess 40*d* at the midpoint with respect to the front and back of the top cover 40. The recess 40*d* is wider in the back half with respect to the midpoint of top cover 40 and narrower in the front part with respect to the midpoint. Two rear intake slits 41 and 41, which penetrate in the up and down directions, are formed in the rear part of the recess 40*d*. These rear slits 41 and 41 extend along the width of the top cover 40 are separated from each other in the front and back directions. Front intake slits 42 and 42, which penetrate in the front/back direction, are formed in the front part 40*b* of the top cover 40. These front slits 42 and 42 extend along the width of the top cover 40 and are separated from each other in the back and front direction.

The rear slits 41 and 41 include a border 41*a* that hangs down as shown in FIG. 4. The front slits 42 and 42 include a border 42*a* that hangs slightly below to enhance strength around the slits.

Top cover 40 includes a grip recess 43 provided at a longitudinally central part and extending laterally thereof. The recess 43 is sized in length and width such that it allows operator's four fingers from a pointing finger to a little finger pulled together to be fitted thereinto.

Grip recess 43 includes a back edge part 43*a* at the same level as the surface of the recess 40*d*, as shown in FIG. 4. The grip recess 43 also includes a bottom surface 43*b* (which acts as a guide when a person inserts his or her fingers), which curves from the front edge 43*a* down toward the front. Both ends of the bottom surface 43*b* are connected to the surface of the recess 40d through right and left sidewalls 43*c*.

The front edge part of the bottom surface 43*b* of the grip recess 43 includes a cut-out slit 43*d*, which opens in the front and back direction. This slit 43*d* is where the fingers go in. The upper edge of the slit 43*d* continues to a front part 40*e* of the recess 40*d*. Beading 44 is formed at the top edge of the slit 43*d*. The beading 44 extends across the entire front edge of the grip recess 43 to enhance its toughness.

An attachment boss 45 is formed on the lower surface of the front edge part 40*c* of the top cover 40. Two attachment bosses 46 and 46 are formed at right and left of the lower surface in the front part of the grip recess 43. Support ribs 47 and 47 hang down and extend in the front-back directions where the bosses 46 and 46 are. Attachment bosses 48 are placed at right and left and at the center of the back lower surface of the top cover 40. A support rib 49 hangs down and extends in the front and back direction where this boss 48 is.

Figure 5:
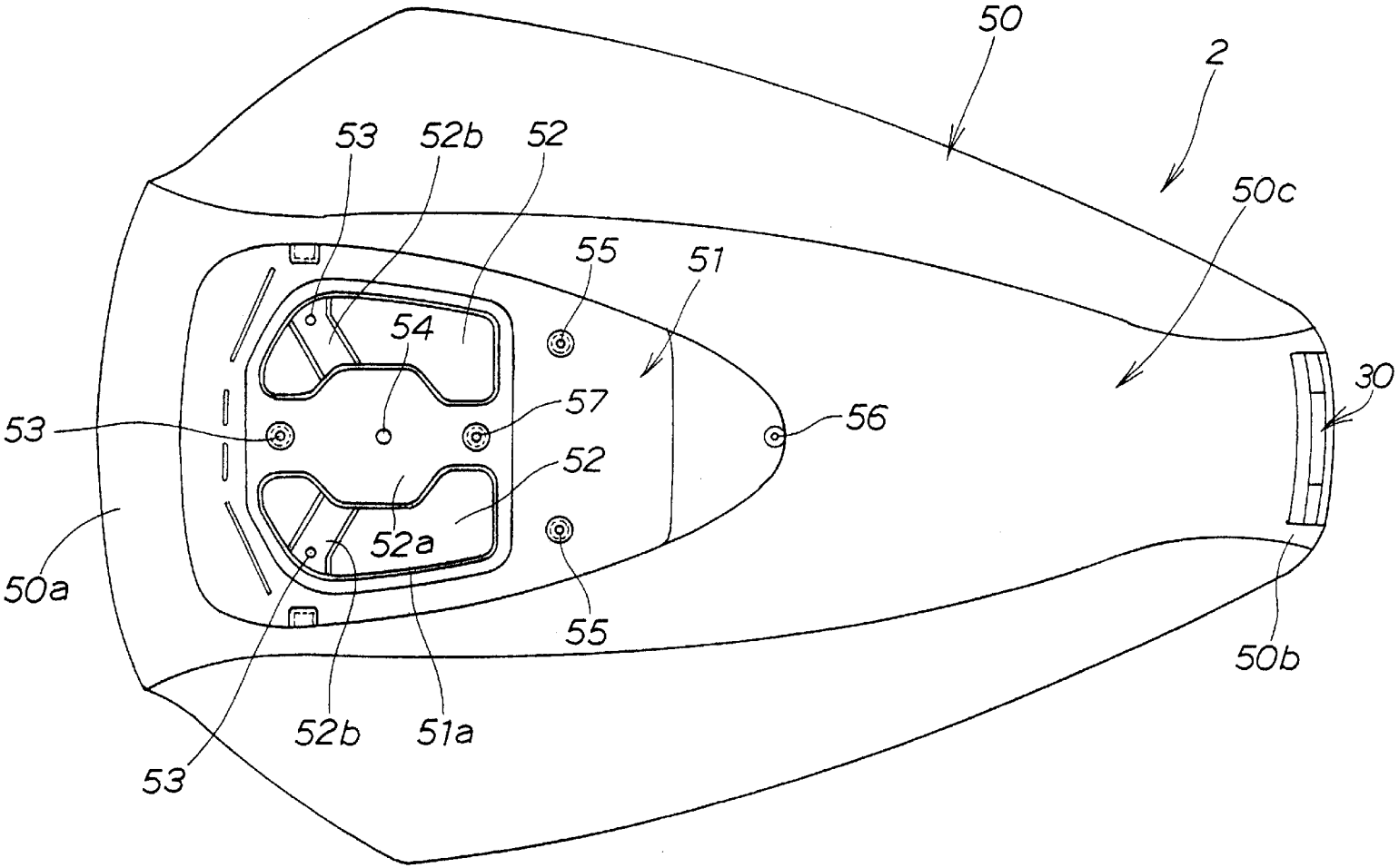
FIG. 5 is a top plan view illustrating the main engine cover unit with the top cover removed.

FIG. 5 shows a top view of the engine cover 2, when the top cover is removed.

A cover main unit 50 of the engine cover 2 includes a rear part 50*a*, which is wider in width, and a front part 50*b*, which is narrower. The cover main unit 50 also includes a top surface 50*c* and a recess 51 (see FIG. 6), which is lower than the top surface 50*c* and is formed between the center point of the top surface 50*c* and the rear part 50*a*.

Figure 7:
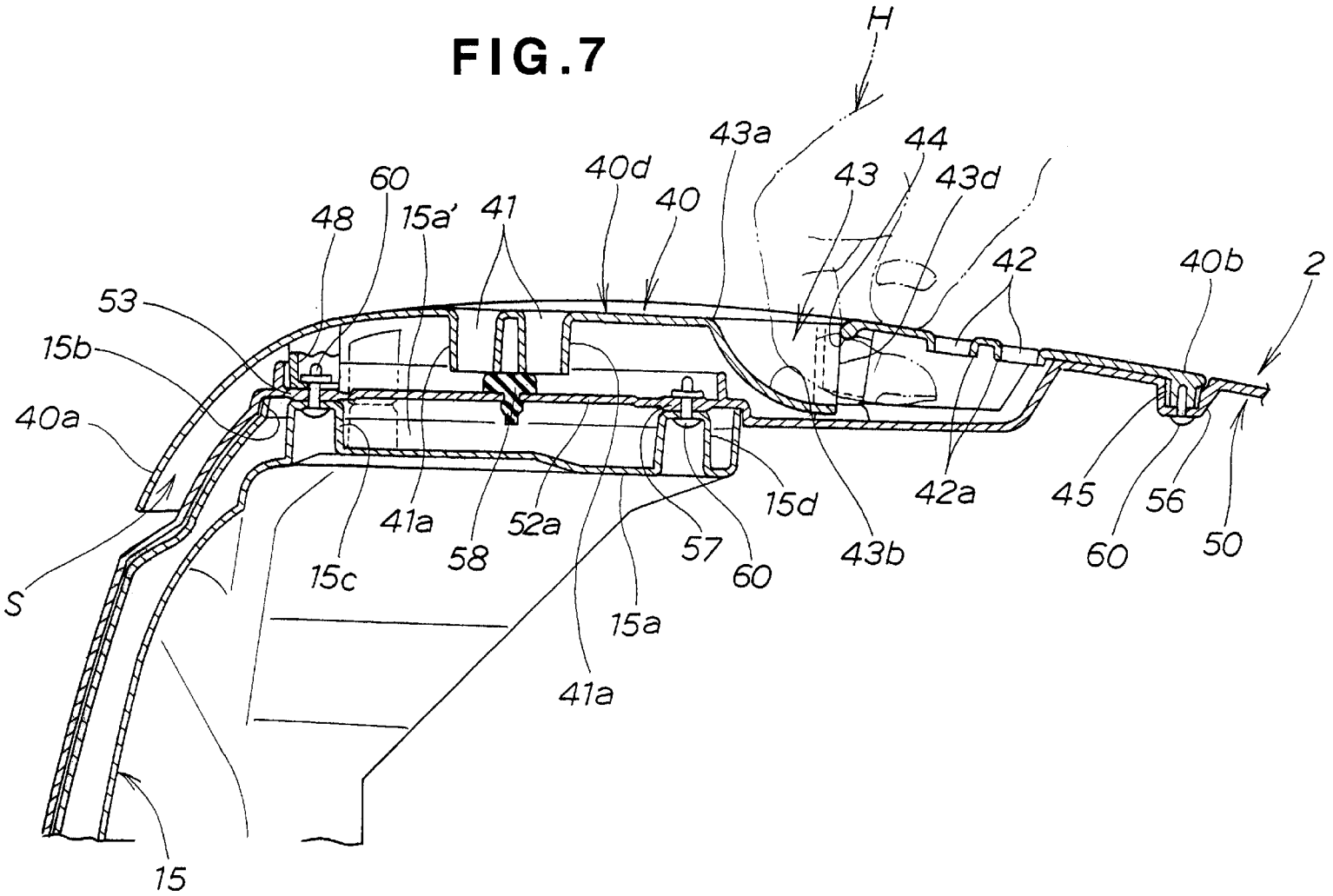
FIG. 7 is a cross sectional view illustrating the top cover, engine cover body, and air intake guide, shown in FIG. 6, as assembled.

The recess 51 has two openings 52 on right and left of a bridge 52*a*, which extends in the front and back directions. Each of the stays 52*b* and 52*b* links the bridge 52*a* and the inner perimeter of the right and left openings 52 and 52, respectively. Attachment bosses 53 are formed on the rear part of the bridge 52*a* and the right and left stays 52*b* and 52*b*, respectively. A hole 54 is formed at the center of the bridge 52*a* to position the rubber bush 58, as shown in FIG. 7. The rubber bush 58 supports the top cover 40. Two attachment bosses 55 and 55 are placed in the front part of the recess 51. An attachment boss 56 is placed in the front edge part.

Figure 6:
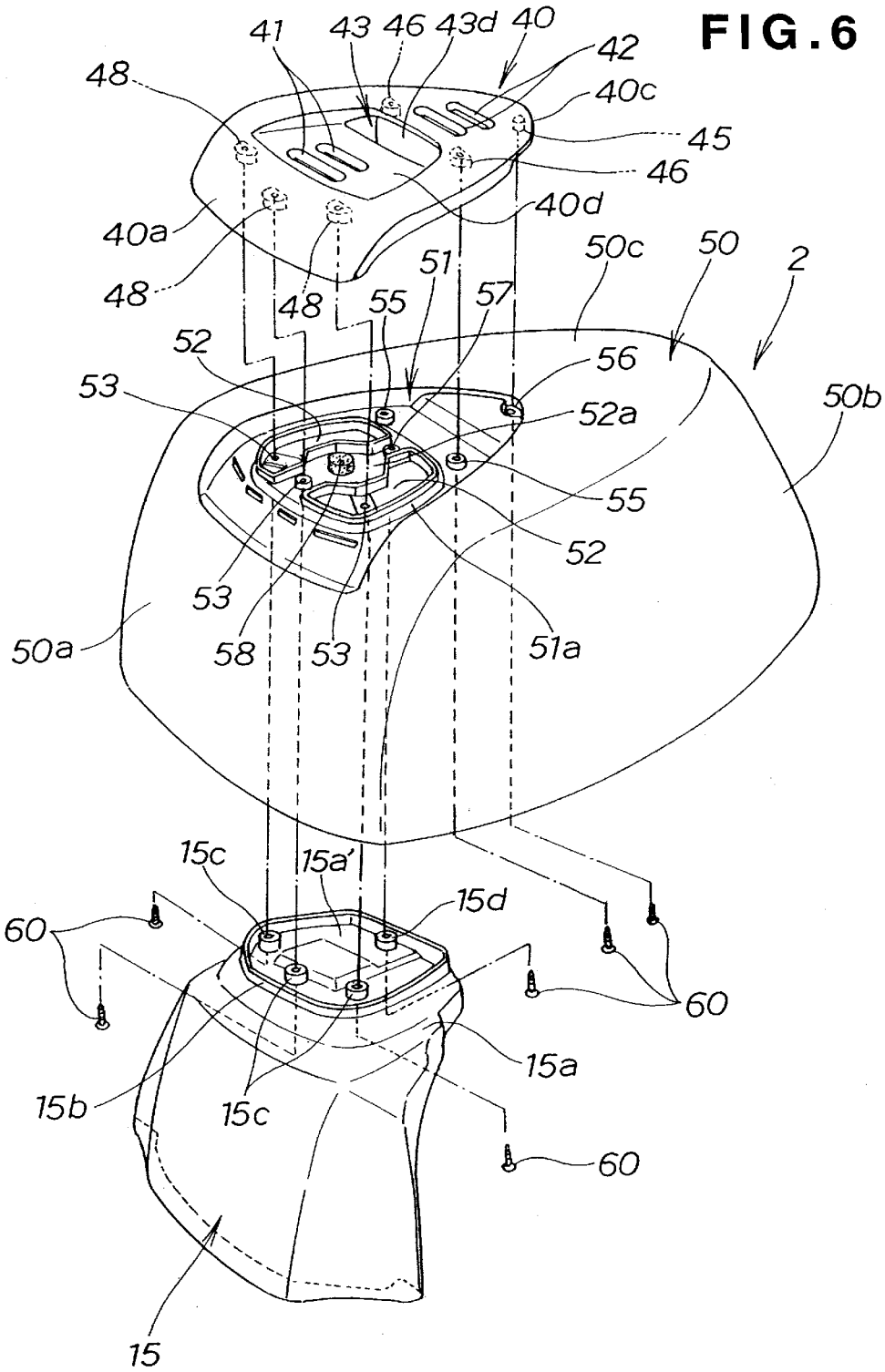
FIG. 6 is a view from an angle in which the top cover, engine cover body, and air intake guide in FIG. 2 have been taken apart.

FIG. 6 shows an exploded view at an angle sufficient to show how the intake guide 15 in FIG. 2, top cover 40, engine cover 2, and the cover main unit 50 are attached.

Intake guide 15 is coupled to the top cover 40 through the cover main unit 50. The intake guide 15 forms a thin, reverse-L shaped box when seen from the side, as in FIG. 2. The frame 50*b* is formed around the opening 50*a* of the top shelf part 50*a* that extends toward the front. Three attachment bosses 15*c* are placed in the rear inside of the frame

50*b* at the center and right and left. An attachment boss 15*d* is placed at the center in the front part.

The shelf part 15*a* of the intake guide 15 is aligned to the lower surface of the recess 51 of the engine cover body 50, while the top cover 40 is placed on top of the recess 51.

The three attachment bosses 48 on top cover 40 are aligned with the three attachment bosses 53 on the engine cover body 50. At the same time, the attachment bosses 53 are aligned to the three attachment bosses 15*c* on the intake guide 15. Screws 60 couple the top cover 40, engine cover body 50, and the shelf part 15*a* of the intake guide 15. Intake guide 15 is attached to the engine cover body 50 by coupling the rubber bush 58 to the opening 54 in the engine cover body 50, and attaching the attachment boss 57 of the engine cover body 50 to the attachment boss 15*d* of the intake guide 15 with screws 60.

Top cover 40 is attached to the engine cover body 50 by attaching the three attachment bosses 45, 46 and 46, which are placed between the front part and the front edge of the top cover 40, to the attachment bosses 56, 55 and 55 placed in the recess 51 of the engine cover body 50.

FIG. 7 shows the top cover for the intake guide 15 attached to the engine cover main unit 50.

Top cover 40 is attached to the rear top surface of the engine cover body 50 through the six attachment bosses 45, 46 and 48, which are connected to the corresponding six attachment bosses 55, 56 and 53 of the engine cover body 50, as shown in FIG. 3. Ribs 47 and 49 around these attachment bosses ensure strong attachment to the engine cover body 50. Engine cover body 50 is strong, because the top cover 40 is attached in the recess 51, the opening 52 is surrounded by the frame 51*a*, and the attachment is to the shelf part 15*a* of the intake guide 15, which includes the frame 15*b*.

In order to move the outboard engine 1 up and down about the tilt axis 7*a*, a person inserts fingers of his or her hand H into the grip recess 43 and pushes the fingertips into the slit 43*d*, as FIG. 7 shows. Because the lower surface 43*b* is curved, the person can insert the fingers smoothly. The beaded top edge 44 of the slit 43*d* protects the fingers smoothly. The beaded top edge 44 of the slit 43*d* protects the fingers and enhances strength.

Thus shown, a person can rotate the outboard engine 1 about the tilt axis 7*a* as though he or she is lifting the outboard engine, by using as a handle the grip recess 43, formed at middle to front half of the top cover 40, by inserting his or her fingers into the recess 43 and holding onto it.

Space S is left between the rear part of the top cover 40 and the rear part of the engine cover body 50, as well as between the peripheral of the top cover 40 and the engine cover body 50, if needed. The space S allows air intake into the intake guide 15. The air coming in from this guide is introduced into the combustion chambers 11*a* through the intake muffler 24, throttle valve 25, and intake manifold 14, as FIG. 2 shows.

In addition to this embodiment, the grip recess 43 can also be formed directly on the top surface of the engine cover 2. It is also possible to place a handle across the width of the grip recess 43.

The present disclosure relates to the subject matter of Japanese Patent Application, No. 2001-035209, filed Feb. 13, 2001, the disclosure of which is expressly incorporated herein by reference in its entirety.

What is claimed is:

1. An outboard engine comprising:

an engine;

an engine cover for covering the engine and peripheral equipment of the engine and having a front end, a rear end opposite the front end and a top surface extending between the front end and the rear end;

an under cover disposed below the engine cover;

an extension case disposed below the under cover;

a gear case with a propeller disposed below the extension case; and a grip recess formed in the top surface of the engine cover and having a cut-out slit opening in a front-and-rear direction of the engine cover for allowing an operator's hand to fit therein to thereby enable gripping of a top part of the engine cover, the grip recess being located closer to the rear end of the engine cover than to the front end but being spaced from the rear end of the engine cover.

2. An outboard engine according to claim 1;

wherein the engine cover comprises an engine cover body and an elongated plate-like top cover placed on an upper rear part of the engine cover body, the top cover extending in the front-and-rear direction of the engine cover, the grip recess being formed in a longitudinally central part of the elongated plate-like top cover.

3. An outboard engine according to claim 1;

wherein the grip recess has a bead formed at a top edge of the cut-out slit.

4. An outboard engine according to claim 1;

wherein the grip recess comprises an opening in the top cover, a curved surface extending downwardly of the opening to guide the operator's fingers into the cutout slit opening, and a bead formed at an upper peripheral edge of the cut-out slit opening.

5. An outboard engine comprising:

an engine;

an engine cover for covering the engine and peripheral equipment of the engine;

an under cover disposed below the engine cover;

an extension case disposed below the under cover;

a gear case with a propeller disposed below the extension case; and a grip recess formed in a top surface of the engine cover for allowing an operator's hand to fit therein to thereby enable gripping of a top part of the engine cover;

wherein the engine cover comprises an engine cover body and a top cover separate from the engine cover body and coupled unitarily with a top part of the engine cover body, the grip recess is formed on the top cover, and the grip recess comprises an opening defined in the top cover, a curved guide provided downwardly of the opening, and a bead formed at edges defining the opening.

6. An outboard engine unit comprising:

an engine;

a housing having an engine cover defining an engine compartment for housing the engine, the engine cover having a front end, a rear end opposite the front end, and a top surface extending between the front end and the rear end;

a mount for mounting the outboard engine unit to a boat such that the outboard engine unit is pivotable about a tilt axis; and a hand grip comprised of a recess formed in the top surface for accommodating an operator's hand to enable the operator to grip the engine cover to pivot the outboard engine unit about the tilt axis, the recess being disposed forward of the rear end of the engine cover to enable the operator to reach the grip, but being disposed closer to the rear end than to the front end to enable the operator to apply a force sufficient to pivot the outboard engine unit about the tilt axis.

7. An outboard engine unit according to claim 6;

wherein the hand grip further comprises a cut-out slit opening in a front-and-rear direction of the engine cover for accommodating the operator's fingers.

8. An outboard engine unit according to claim 7;

wherein the recess of the hand grip has curved bottom surface extending downwardly from the top surface of the engine cover and serving as a finger guide for guiding the operator's fingers into the cut-out slit opening.

9. An outboard engine unit according to claim 8, wherein the recess of the hand grip recess further comprises a bead formed at an upper peripheral edge of the cut-out slit opening.

10. An outboard engine unit according to claim 6;

wherein the housing further comprises an under cover disposed below the engine cover, an extension case disposed below the under cover, and a gear case having a propeller disposed below the extension case.

11. An outboard engine unit according to claim 6;

wherein the engine cover has an air intake opening in the top surface; and further comprising an air intake guide disposed within the engine cover and having an air passageway surrounded by a wall that is separate from an inner surface of the engine cover, the air intake guide having one end communicating with the air intake opening of the top surface of the engine cover and another end opening into the engine compartment.

12. An outboard engine unit according to claim 11;

wherein the air intake guide has a top opening connected to the air intake opening in the top surface of the engine cover.

13. An outboard engine unit according to claim 12;

wherein the air intake opening, the top opening, and the hand grip lie in substantially the same plane.

14. An outboard engine unit according to claim 11;

wherein the air intake guide has a top opening connected to the air intake opening provided in the top surface of the engine cover, the top opening having a plurality of bosses surrounded by a frame for connecting the air intake guide to the air intake opening.

15. An outboard engine unit according to claim 11;

wherein the air intake guide has a first opening connected to the air intake opening, a second opening in the engine compartment for discharging air taken in through the air intake opening, and a main body connecting the first and second openings and extending downward from the air intake opening into the engine compartment.

16. An outboard engine unit according to claim 15;

wherein the engine cover has a depressed portion in the top surface in which the air intake opening is formed; and further comprising a top cover member covering the depressed portion and having formed therein the hand grip and one or more openings in communication with the air intake opening.

17. An outboard engine unit according to claim 16;

wherein another air intake opening is defined by a space between the top cover member and the engine cover.

18. An outboard engine unit according to claim 11;

wherein the air intake guide has a vertically elongated main body portion extending from the one end to the other end, and a horizontally oriented upper portion in which the one end is formed, the upper portion being in substantially the same plane as the air intake opening and the hand grip.

* * * * *